United States Patent [19]

Klammer et al.

[11] Patent Number: 4,874,104

[45] Date of Patent: Oct. 17, 1989

[54] HOT WATER STORAGE TANK

[76] Inventors: Josef Klammer, Esplanade 28, Gmunden, Austria, 4810; Werner Grosschädl, Hutterweg 2, Bad Ischl, Austria, 4820

[21] Appl. No.: 225,967

[22] Filed: Jul. 29, 1988

[30] Foreign Application Priority Data

Jan. 12, 1988 [DE] Fed. Rep. of Germany ..... 3800699

[51] Int. Cl.[4] ..... B65D 6/16; F24H 1/18; F24H 9/14

[52] U.S. Cl. ..... 220/4 B; 110/320; 122/13 A; 126/344; 219/312; 220/3; 220/5 A; 220/8; 264/248

[58] Field of Search ..... 29/157 R, 157.4, 434, 29/445, 463; 122/4 A, 13 A, 119; 110/320; 126/344, 437; 220/3, 4 B, 4 E, 4 C, 5 R, 5 A, 8, 23.6; 219/310, 312, 314; 264/248, 249

[56] References Cited

U.S. PATENT DOCUMENTS

| | | | |
|---|---|---|---|
| 2,162,462 | 6/1939 | Reid | 219/314 |
| 3,471,058 | 10/1969 | Latham et al. | 220/8 |
| 3,521,604 | 7/1970 | Nickel | 122/13 A |
| 3,730,144 | 5/1973 | Arzberger | 219/312 |
| 4,070,543 | 1/1978 | Thompson et al. | 220/8 |
| 4,424,767 | 1/1984 | Wicke et al. | 122/13 A |
| 4,440,307 | 4/1984 | Bartels et al. | 220/8 |
| 4,574,969 | 3/1986 | Mays | 220/8 |

FOREIGN PATENT DOCUMENTS

| | | | |
|---|---|---|---|
| 549046 | 10/1956 | Italy | 219/314 |
| 624360 | 9/1961 | Italy | 219/314 |
| 734761 | 8/1955 | United Kingdom | 219/312 |

*Primary Examiner*—George L. Walton
*Attorney, Agent, or Firm*—Brown, Martin, Haller & McClain

[57] ABSTRACT

A vertical hot water storage tank with an access opening in its underside, for positioning an internal heating element in the tank, and connectors for the supply of cold water to the tank and for the egress of hot water therefrom, is in the form of a pressure tight cylindrical vessel. In order to simplify the construction of the vessel, it is assembled from separate modular elements made of a plastics material, which are relatively adjustable to determine the capacity of the vessel and which are finally bonded together. The modular elements may comprise a pair of inter-fitting top and bottom lid elements, or top and bottom lid elements interfitting with a central tubular element. The capacity of the vessel may be determined prior to the bonding of the elements together, by the extent to which they overlap one another or by suitable dimensioning of the elements. A storage tank may comprise a plurality of such cylindrical vessels which are interconnected by way of upper and lower piping connections which communicate with the ends of the lid elements, for improved water circulation. The piping connections are in the form of tubular stub connectors which are mated with one another and are then bonded together.

18 Claims, 5 Drawing Sheets

HOT WATER STORAGE TANK

FIELD OF THE INVENTION

This invention relates to a hot water storage tank, which term includes within its scope a hot water boiler, having an upper side and an underside, an access opening in the underside for a heating element to be positioned within the tank, and cold water supply, and hot water outflow, connectors communicating with the interior of the tank.

BACKGROUND OF THE INVENTION

A hot water boiler of the kind set forth above, is described in the specification of Austrian patent application A8167/73 the name of Tirolia-Werke. Such boilers comprise watertight, vertical, cylindrical vessels connected by way of upper and lower piping connections, the vessels being made of metal and having connector stubs of said connections, projecting laterally from tubular portions of the vessels, at positions back from their ends.

The connecting stubs of the vessels are welded together to provide what is known as, a "flat" or a "shallow", hot water storage tank. Such metal vessels are difficult to produce and to weld together. Also, because of the location of said stubs, water does not flow through parts of the upper and lower ends of the vessels, unused space being therefore present therein. When the tank is heated, the water circulation is imperfect, so that considerable thermal stresses materialise, which may cause leakage at the supply and outflow connectors.

Also, the vessels need to be purpose built for particular tank capacities so that a substantial number of different size vessels must be held in stock.

SUMMARY OF THE INVENTION

A hot water storage tank according to the invention may comprise a plurality of cylindrical vessels or, indeed, a single cylindrical vessel. The invention serves to simplify the manufacture of the tank in that the, or each, vessel is assembled from separate modular elements made of a plastics material, for example post-chlorinated polyvinylchloride (PVCC), for subsequent bonding together, and which are relatively adjustable to determine the capacity of the tank. These modular elements may comprise upper and lower lid elements which can be assembled in overlapping, mating relationship over a bonding area, or upper and lower lid elements which can be assembled in overlapping mating relationship to a tubular central element over bonding areas. The term bonding as used herein includes within its scope, welding.

Where the tank comprises a plurality of the cylindrical vessels, interconnected by way of upper and lower piping connections, these are positioned at the apices of the lid elements, which are preferably dome-shaped, so that the presence of said unused volume is avoided. In order to provide a secure clamping structure for the heating element, the access opening which is formed in a lower lid element tapers outwardly of the lower lid element in which it is formed, and is of elliptical shape. The heating element is preferably enclosed in a cover which is complimentary with the access opening, in conjunction with a safety temperature limiter and with a temperature selector.

Where the said central tubular element is provided, the extent to which the lid elements overlap it, can be adjusted prior to the bonding operations, to determine the capacity of the vessel. Where a vessel comprises only a pair of mating lid elements, these may be provided with mating tubular portions to be bonded together, and being of a predetermined length in accordance with the required capacity of the vessel. The lid elements are preferably formed with internal circular recesses or groves whereby the vessel is of somewhat increased wall thickness over the region of overlap, that is to say over the bonding area. Also, for effective bonding of the modular elements, the length of overlap should in each case amount to at least a third of the diameter of the vessel over the bonding area.

Where the storage tank comprises a plurality of cylindrical vessels, the piping connections are preferably in the form of tubular connector stubs which project from the lid elements from one or both sides of a vessel, each stub being matable with a complementary stub of an adjacent vessel of the tank. These mating stubs can readily be bonded together in their overlapping relationship. The stub connector of the lower lid element, in which said access opening is formed, is preferably spaced from the access opening to provide a lime collector receptacle.

The distance between adjacent cylindical vessels, is preferably small enough to facilitate the introduction of polyurethane foam between the vessels in the formation of polyurethane jackets thereabout.

DETAILED DESCRIPTION OF THE INVENTION

Figure 1:
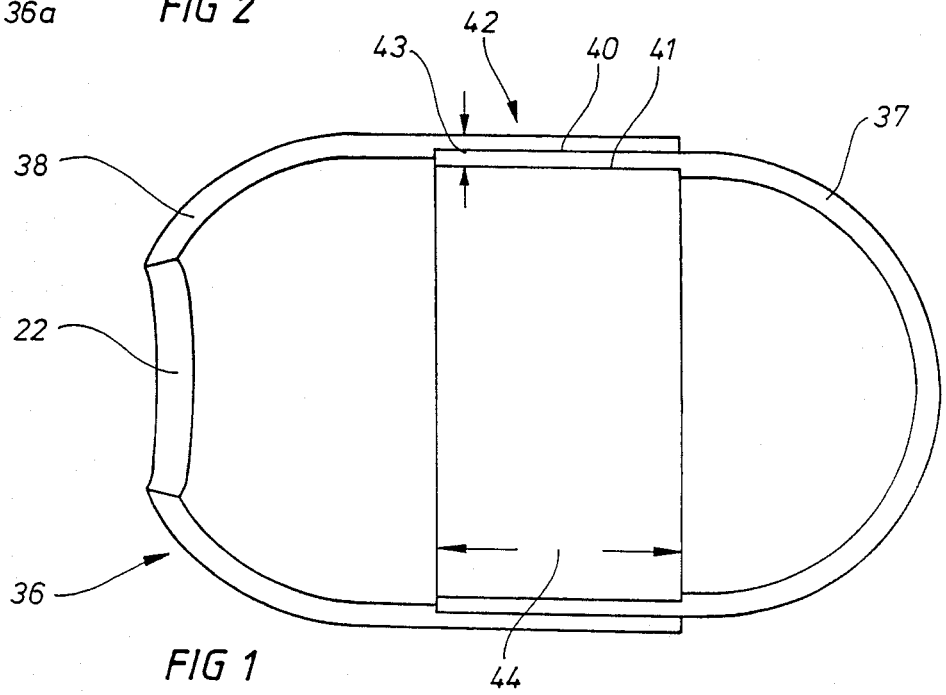
FIG. 1 is a diagramatic sectional view of a hot water storage tank according to a first embodiment of the invention.

In the drawings, like reference numerals designate like parts. As shown in FIG. 1, a single pressure-tight cylindrical vessel 36 constituting a small, hot water storage tank having a capacity of, for example 10 liters, comprises two domed, upper and lower lid elements 37 and 38 respectively, which are assembled by plugging them into one another in mating relationship so that there is an overlap 44 between the plugged in portions 42 of the elements 37 and 38, these portions are then bonded or welded together along the overlap 44.

Figure 2:
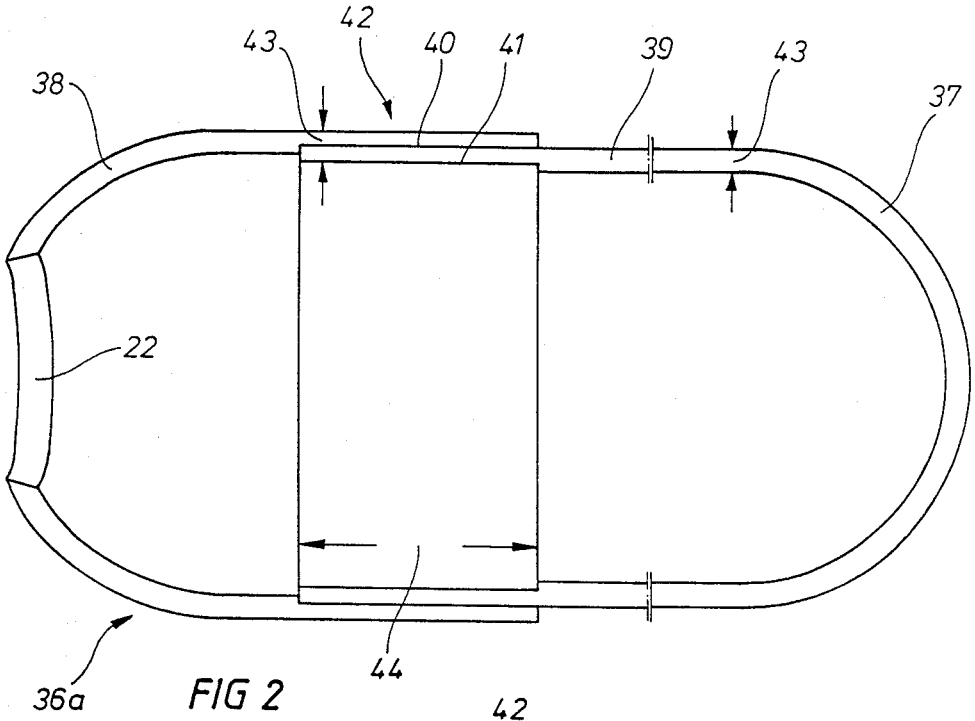
FIG. 2 is a similar view to that of FIG. 1 but showing a similar hot water storage tank having a greater capacity than that of FIG. 1.

The vessel 36*a* shown in FIG. 2, is similar to that of FIG. 1 but is of greater capacity.

The plugged in portions 42 of the lid elements 37 and 38 in FIGS. 1 and 2, comprise annular extensions defining circular internal grooves or recesses 40 and 41 of such a diameter that the wall of the vessel is of greater thickness 43, over the portions 42 as compared with the remainder of the wall of the vessel. The capacity of the vessel is determined by the extent of the overlap 44.

According to FIGS. 1 and 2, the lid element 38 has an access opening 22 of elliptical shape, and tapering in the outward direction of the vessel. Lid elements 12, 13 and 32 of the embodiments described below with reference to FIGS. 3 to 7, have access openings 22 of the same shape.

A heating element 72 having a tapered cover complementary with the opening 22, is inserted thereinto and is bonded therein. The heating element 72 is thereby simply and sealingly assembled to the vessel. Since the opening 22 is enlarged inwardly of the vessel it provides a tapered sealing seat that is to say it provides a clamping structure for said cover.

The heating element 72, together with a safety temperature limiter and a temperature selector, may be pressed, or bonded into the cover 73, which may be a deep drawn metal, or plastics material, cover, the external dimension of which corresponds to dimension of the opening 22, the larger elipse of the cover 73 being positioned inwardly of the opening 22 and the smaller elipse of the cover being positioned outwardly of the opening 22.

In order to assemble the cover to the vessel, the cover is turned through 90 degrees, tilted sideways and inserted into the opening 22, is turned back through 90 degrees and is pushed down into contact with the wall of the opening 22.

By virtue of the overpressure within the vessels 1, 4, 4*a*, 35, 36 and 36*a*, shown in FIGS. 1 to 7, the cover is pressed against the wall of the outwardly tapered elliptical access opening 22, so that the seal between the vessel and the cover is permanent and is maintenance free. The cover is easily assembled to, and disassembled from, the vessel so that servicing thereof is facilitated.

For the purpose of protecting the heating element during transport of the vessel, the cover is externally secured to the vessel, by means of a threaded pin, a counter-element and a wing nut, before the cover is bonded into the opening 22.

In the vessel 36*a* shown in FIG. 2, the lid element 37 has an extended tubular portion 39 whereby the volume, and thus the capacity, of the vessel 36*a* is greater than that of the vessel 36 of FIG. 1. Thus the length of the tubular portion 39 may be selected to provide a vessel of the required capacity.

The extent of the overlaps 44 in the embodiments of FIGS. 1 to 7 are such that the overpressure within the vessel tends to urge the overlapping parts thereof together, all the tighter.

The extensive overlap 44 thus ensures à particularly satisfactory joint between the lid elements 37 and 38 or between the lid elements and the tubular central element (described below) with reference to FIGS. 3 to 7. Especially also because of the homogeneous structure of the overlap 44, heat patches cannot develop, so as to cause leakage, as they would in the case of welded joints between metal elements.

As mentioned above, the lid elements 37 and 38 have annular extensions which are bonded together. The diameter of the circular grooves or recesses 40 and 41 is advantageously so selected that the increased thickness 43 over the plugged in portions 42 does not greatly exceed the thickness of the remainder of the vessel wall, to produce a homogenous area joint between the lid elements 37 and 38, which acting as a spontaneous seal, ensures improved operational reliability even under high pressure and great heat.

In the embodiments of FIGS. 1 to 7, the length of the overlap 44, that is to say the bonding area, amounts to at least one third of the diameter of the vessel over the bonding area so that heat stresses are satisfactorily balanced, that is to say temperature rises are spread evenly over the vessel wall in a particularly advantageous manner.

Figure 3:
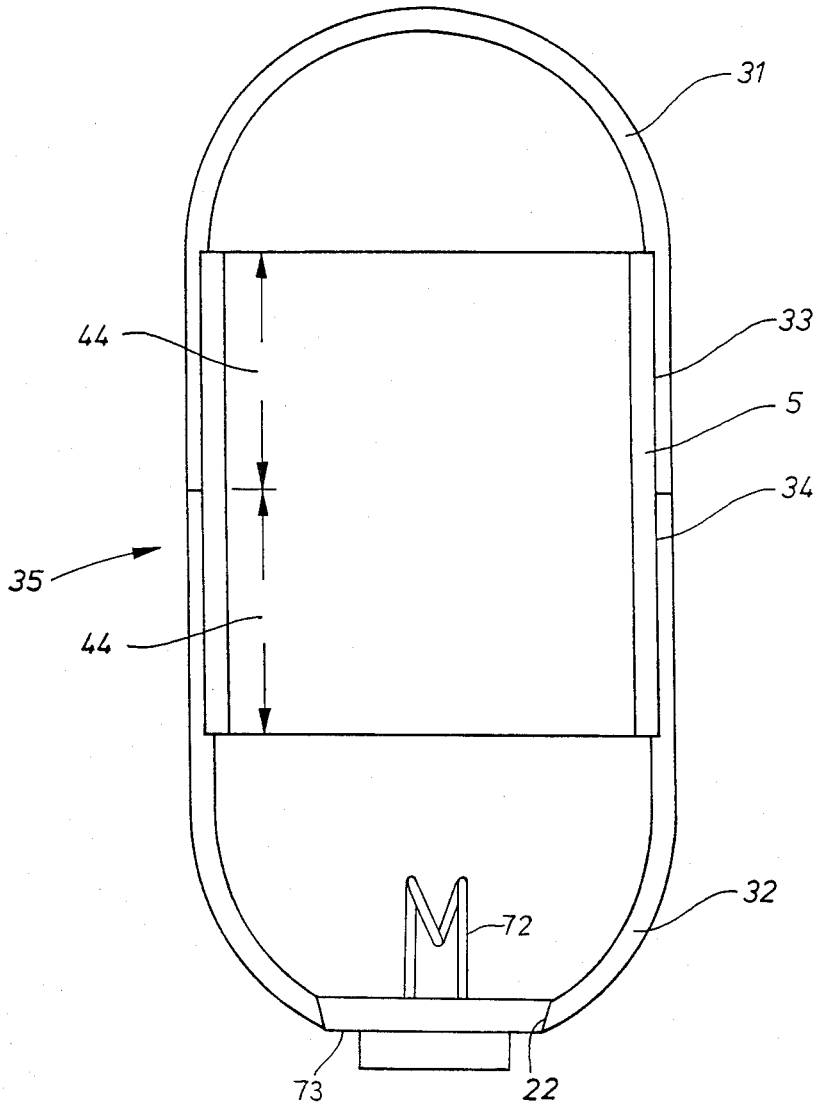
FIG. 3 is a diagramatic sectional view of a hot water storage tank according to a second embodiment of the invention.

In the embodiment of FIG. 3, the vessel, which is referenced 35, comprises the tubular central element mentioned above. In this case, the lid elements 31 and 32 surround the central tubular element, which is referenced 5, within the overlap 44 whilst bearing, at least partially, against the ends of the element 5 by means of shoulders defined by the ends of the circular recesses 33 and 34, as shown in FIG. 3.

The circular recesses 33 and 34 of the lid elements 31 and 32 are identically formed, the capacity of the vessel being capable of being increased or decreased, very simply, by pulling the elements 31 and 32 apart from one another on the central element 5, or by moving them towards each other thereon, as the case may be, before the bonding step. The vessels described below, with reference to FIGS. 4 to 7 are also adjusted for capacity in this way.

Figure 8:
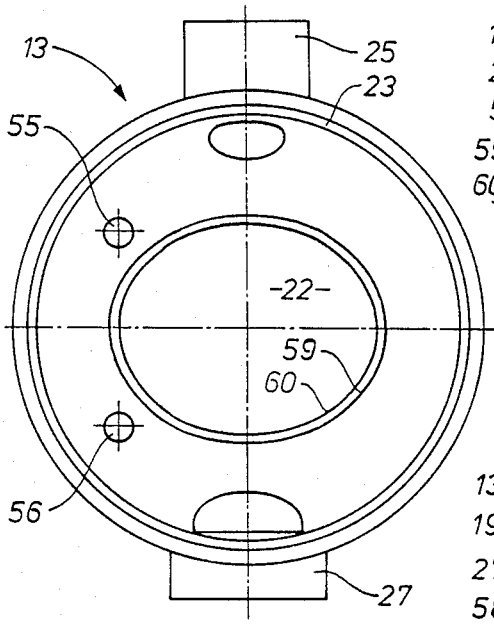
FIG. 8 is an elevational view of a lid element for a hot water storage tank.

The vessels 35, 36, and 36*a* described above the reference to FIGS. 1 to 3 each constitute hot water storage tank per se, hot and cold water connections to these vessels being provided in accordance with the teaching of FIG. 8.

In the embodiments of FIGS. 1 to 7, the connections 55 and 56 (FIG. 8) for cold and hot water, respectively, are moulded with the lower lid element 12, 13, 32 or 38 which is provided with the access opening 22. The hot water outlet is upwardly extended, by means of a pipe (not shown) of plastics material which is plugged into or over the injection moulding socket situated at the inside. The cold water connection is also of plastics material at the inside and is so designed as to cause a minimum of flow phenomena within the storage tank. The structure described has the advantage that the "lead-ins" cannot incur leakage and that the water connections need not be tied off if the heating element is to be replaced.

The lid elements and the central element are made of a plastics material, for example, post-chlorinated polyvinylchloride (PVCC). The resistance of the plastics material to the setting of lime, prevents constriction of the cold water inflow. Also, the formation of a cold conduction bridge to the cold or hot water piping system is prevented in an optimum manner.

Figures 4, 5, 6:
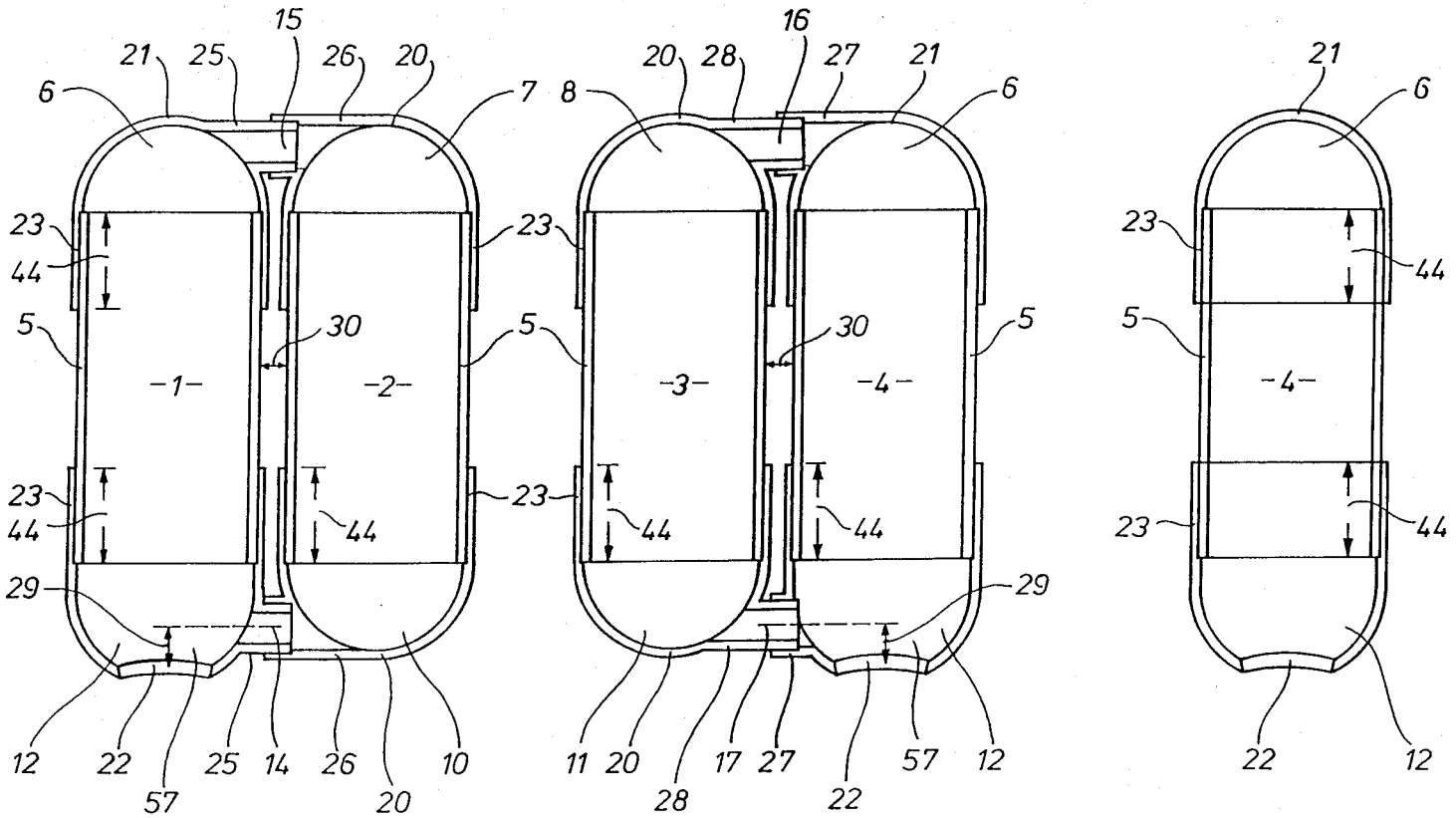
FIG. 4 is a diagramatic sectional view of a hot water storage tank according to a third embodiment of the invention.
FIG. 5 is a similar view to that of FIG. 4 but illustrating a modification of the embodiment thereof.
FIG. 6 is a diagramatic sectional view of the tank of FIG. 5 taken in a direction at right angles to the plane of FIG. 5.

According to the embodiment of FIGS. 4 to 6, juxtaposed, vertical cylindrical vessels 1 and 2, and 3 and 4, are assembled to provide so called flat storage tanks by way of piping connections 14 and 15 according to FIG. 4, and piping connections 16 and 17 according to FIG.

5 thereby to form twin pipe, pressure tight, suspended storage tanks.

According to FIG. 4, connector stubs 25 of the vessel 1 are externally surrounded by mating connector stubs 26 of the adjacent vessel 2, whereas according to FIG. 5, connector stubs 27 of the vessel 4 are internally traversed by mating connector stubs 28 of the adjacent vessel 3. In the embodiments of FIGS. 4 to 6, the cylindrical vessels 1 and 4, respectively, have cylindrical vessels 2 and 3, respectively, connected to them to produce in each case, a storage tank of increased volume. The upper lid elements 6, 7 and 8 in FIGS. 4 and 5, have connector stubs 25, 26, 27 and 28 connected at the apices 20 and 21 of these lid elements and thus at the highest points on the vessels in each case, so that unused volume enabling the forming of air inclusions in the lid elements is thereby averted so that the water circulation is particularly satisfactory, wherease in commercially available hot water storage vessels, the piping connections therebetween are spaced back from the ends of the vessels instead of at their extremities. The lower lid elements 10, 11 and 12 have connector stubs 25, 26, 27 and 28, connected at the apices of these elements and thus at the lowest points on the vessels.

The positioning of the connector stubs in the domed lid elements results in an increase in the utilizable storage capacity, as compared to commercially available flat storage tanks as well as, generally, commercially available circular storage tanks.

In order to limit the temperature at the terminals of the heating elements, it is a common practice to leave the lower extremities of the heating elements unheated but since cold water has a higher specific weight than hot water, water which is present below the hot parts of the heating elements is hardly heated at all. In the embodiments of FIGS. 4 to 7, the water does not circulate in a tube, as in a conventional circular storage tank, but between a plurality of tubes, so that the whole volume of water constantly flows past the heating element during the heating process.

Conventional flat storage tanks do not have this advantage, since the upper and lower piping connections between the vessels are situated back from the extremities of the vessels so that they have the same disadvantage as conventional circular storage tanks.

Figure 7:
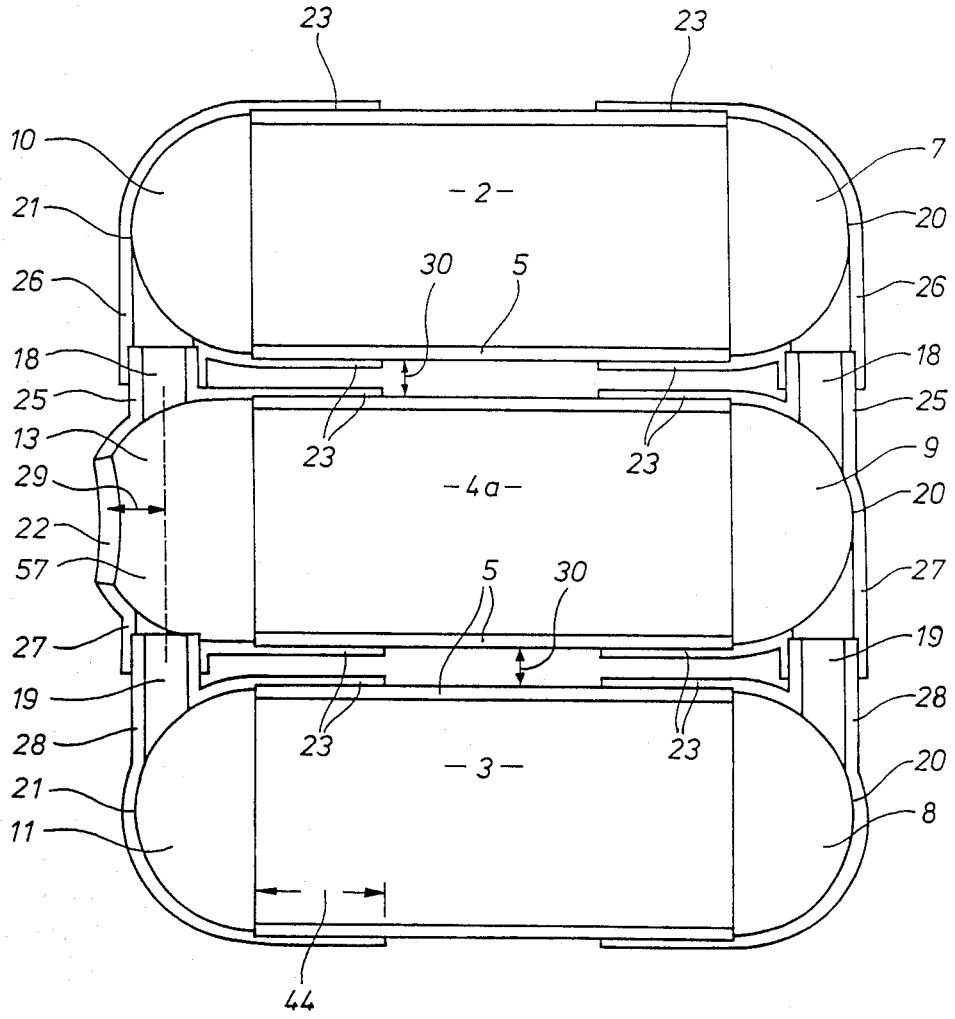
FIG. 7 is a diagramatic sectional view of a hot water storage tank according to a fourth embodiment of the invention.

In the embodiment FIGS. 4 to 6, the lid elements 6, 7 and 8 and 10, 11, and 12 are provided, as are the lid elements 9 and 13 according to FIG. 7, with a circular extension defining a circular recess 23, defining an annular surface surrounding the tubular central element 5 over a length of at least one third of its diameter, along the bonding area, to provide the overlaps 44, thereby establishing a particularly homogeneous overheating proof connection which uniformly transmits the heat produced to the remaining parts of the vessels with heatout accumulation.

In the embodiments of FIGS. 4 to 7, gaps 30 are provided between the vessels 1 and 2, 3 and 4, and 2, 3 and 4*a*, respectively, which, especially if the vessels are provided with polyuretherane foam jackets, restrains rising temperatures in one vessel from affecting the temperature of the next adjacent vessel in an uncontrolled manner. Since as mentioned above, particularly advantageous water circulation within the vessels is provided, thermal stresses are largely averted from the start.

As shown in FIG. 7, the three juxtaposed, vertical, cylindrical vessels 2, 3 and 4*a* are arranged in combination to provide a three tube, pressure tight, suspended storage tank. In this embodiment, the vessel 4*a* has upper and lower lid elements 9 and 13, respectively, having connector stubs 25 and 27 at both sides thereof for mating connection to connector stubs 26 and 28 of the adjacent vessels 2 and 3, respectively. In order to ensure that the vessels 2 and 3 are correctly assembled to the vessel 4*a* the stubs 26 of the vessel 22 are arranged to receive the stubs 25 of the vessel 4*a* and the stubs 28 of the vessel 3 are arranged to be received in the stubs 27 of the vessel 4*a*.

The gaps 30 between the juxtaposed, vertical vessel of the embodiments 4 to 7 may be filled with polyurethane foam. Since the gaps 30 are of small width, the duration of the foaming operation may be desirably short and the foam surface more homogeneous since its surface shrinkage is small. The foam may be applied at several spray on points, depending on the length of the storage tank, to provide jackets about the vessels.

In the embodiments of FIGS. 4 to 7, the stubs 25 and 27 each have a predetermined spacing 29 above the corresponding access opening 22, thereby providing a lime collector receptable 57 proximate to the opening 22. The high temperature of the heating element, causes lime to settle thereon, which falls are from time to time and collects in said receptable 57. No lime is deposited on the vessel itself because the plastics material of which it is made has an anti fouling property. The lime collecting in the receptacle 57 does not obstruct the circulation of water between the vessels.

As shown in FIGS. 4 and 5, the lower lid element 12, having the access opening 22, has in each case, the connector stub 25 or 27 projecting from one side thereof, the lower lid element 13 in the embodiment of FIG. 7 having the connector stubs 25 and 27 projecting from opposite sides thereof although these stubs may be arranged at an angle with respect to one another.

Figure 9:
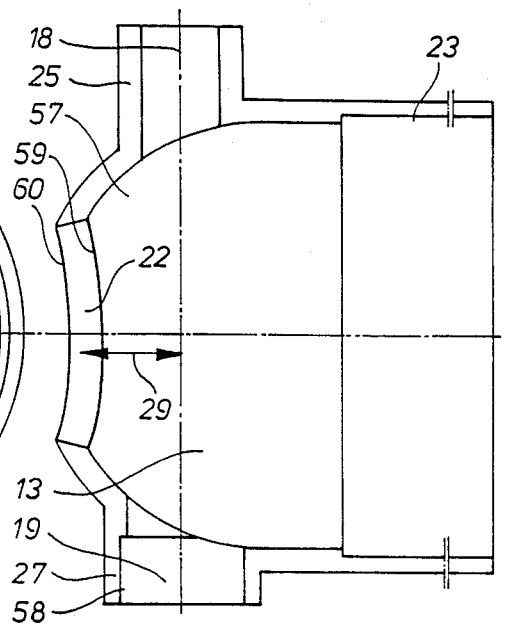
FIG. 9 is a longitudinal sectional view of the lid element of FIG. 8.

As shown in FIG. 9, the stub 27 has a counter sink or circular recess 58 for receiving the mating connector stub. Also according to FIG. 9, the access opening 22 has an enlarged diameter 59 at its inner side and which is of elliptical form and merges into a smaller diameter 60 at the outer side of the lid element 13, to provide a tapered seat in the opening 22 so that the said cover of the heating element is held securely therein without supplemental bonding.

Figure 10:
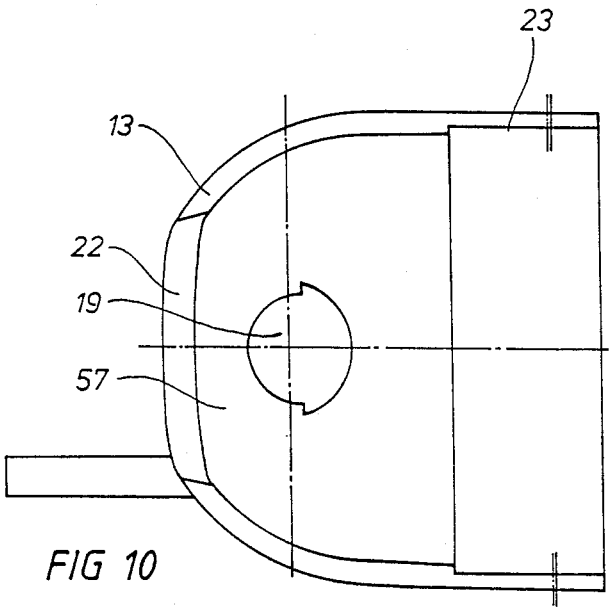
FIG. 10 is a longitudinal sectional view of the lid element of FIG. 8, but being taken in a direction at right angles to the plane of FIG. 9.

A pipe connection 19, which is shown in FIG. 10, as seen from the interior of the lid element 13, may be simply moulded therewith and may then be subjected to a finishing process.

Hot water storage tanks of the embodiments of FIGS. 1 to 7, are modular, that is to say they are each made up of a "building set" comprising only a few modules, i.e., the lid elements and also the central tubular elements, as the case may be, so that by the use of these, vessels of a plurality of different capacities may be constructed. The individual modules, which are made of plastics materials may be assembled as required and may easily be bonded together.

By virtue of the construction of the lid elements and the central elements, where provided, to define the overlaps 44, in conjunction with the positioning of the pipe connections at the apices 20 and 21, and by virtue of the tapered construction of the access openings 22, the storage tanks, according to the embodiments described above, are, despite their uncomplicated structural form, surprisingly more reliable in operation and have a higher efficiency as compared with conventional metal hot water storage tanks.

What is claimed is:

1. A hot water storage tank having an upper side and an underside, an access opening in said underside for a heating element positioned within the tank, and cold water supply, and hot water outflow, connectors communicating with the interior of the tank, the tank comprising at least two juxtaposed, vertical, pressure tight, cylindrical vessels interconnected by way of upper and lower piping connections, the cylindrical vessels being assembled from separate telescopic modular elements of plastic material which are relatively adjustable to determine a desired capacity of the tank, whereby said telescopic modular elements are bonded together after said desired capacity has been determined, said modular elements comprising a tubular central element and upper and lower lid elements attachable to the top and bottom, respectively, of said central element in overlapping relationship therewith, said piping connections communicating with said lid elements at apices thereof and said access opening, which is provided in a lower lid element, tapering outwardly thereof for the insertion of the heating element into said opening and securing it therein.

2. A storage tank as claimed in claim 1, wherein the lid elements are domed shaped and receive the central tubular element in internal circular recesses defined by the lid elements, each lid element overlapping said central element for the provision of an area for bonding said lid element to said central element, to the extent of at least one third of the diameter of said bonding area.

3. A storage tank as claimed in claim 1, wherein the piping connections are in the form of connector stubs projecting horizontally from the lid elements, the stubs of each vessel mating with corresponding stubs of another of the vessels and being bonded thereto.

4. A storage tank as claimed in claim 3, wherein the vessels are three in number, the connector stubs of one vessel projecting from opposite sides of the lid elements thereof, each of the stubs being received in a corresponding stub of a respective one of the other two vessels.

5. A storage tank as claimed in claim 1, wherein the piping connection of said lower lid element having said access opening, is spaced from said access opening to provide a lime collector receptacle.

6. A storage tank as claimed in claim 1, wherein the vessels are closely spaced for the provision of a filling of expanded polyurethane therebetween.

7. A storage tank as claimed in claim 1, wherein each lid element overlaps said central element to an extent equal to at least one third of the diameter of the vessel over the bonding area.

8. A storage tank as claimed in claim 1, wherein said access opening is of elliptical shape.

9. A storage tank as claimed in claim 1, wherein said modular elements are formed from post-chlorinated polyvinylchloride.

10. A hot water storage tank having an upperside and an underside, an access opening in the underside for positioning a heating element within the tank, and cold water supply, and hot water outflow, connectors communicating with the interior of the tank, the tank comprising a single pressure-tight, vertical, cylindrical vessel assembled from separate telescopic modular elements of plastics material which are relatively adjustable to determine a desired capacity of the vessel, whereby said telescopic modular elements are bonded together after said desired capacity has been determined, said modular elements comprising a tubular central element and upper and lower domed lid elements attachable to respective top and bottom ends of said central element, said lid elements defining circular internal recesses for receiving said ends and the access opening being formed in the lower lid element and tapering outwardly of the vessel, for the insertion of the heating element into said opening and securing it therein.

11. A storage tank as claimed in claim 10, wherein said circular recesses are dimensioned so that the vessel is of increased wall thickness along said circular recesses.

12. A storage tank as claimed in claim 10, wherein each lid element overlaps said central element to an extent which is at least equal to one third of the diameter of the vessel over the bonding area.

13. A storage tank as claimed in claim 10, wherein said access opening is of eliptical shape.

14. A storage tank as claimed in claim 10, wherein said modular elements are formed from post-chlorinated polyvinylchloride.

15. A hot water storage tank having an upper side and an underside, an access opening in the underside for positioning a heating element within the tank, and cold water supply, and hot water outflow, connectors communicating with the interior of the tank, the tank comprising a single, vertical, pressure-tight, cylindrical vessel assembled from separate telescopic modular elements of plastics material, said elements comprising upper and lower, domed lid elements from which project tubular mating portions defining circular internal recesses and the length of which are relatively adjustable to each other for determining a desired capacity of the vessel, whereby said telescopic modular elements are bonded together after said desired capacity has been determined, the access opening being formed in said lower lid elements and tapering outwardly of the vessel for the insertion of the heating element into said opening and securing it therein.

16. A storage tank as claimed in claim 15, wherein said tubular portions overlap one another to an extent which is equal to at least one third of the diameter of the vessel over the bonding area.

17. A storage tank as claimed in claim 15, wherein said access opening is of elliptical shape.

18. A storage tank as claimed in claim 15, wherein said modular elements are formed from post-chlorinated polyvinylchloride.

* * * * *